US010898402B2

(12) United States Patent
Baker et al.

(10) Patent No.: US 10,898,402 B2
(45) **Date of Patent: *Jan. 26, 2021**

(54) PROGRAMMABLE EXAMINATION AND PROCEDURE TABLES AND CHAIRS

(71) Applicant: Medical Technology Industries, Inc., Salt Lake City, UT (US)

(72) Inventors: Jeffrey H. Baker, Cottonwood Heights, UT (US); Bradley H. Baker, Riverton, UT (US); Darren D. Walters, Layton, UT (US)

(73) Assignee: MEDICAL TECHNOLOGY INDUSTRIES, INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/715,833

(22) Filed: Dec. 16, 2019

(65) Prior Publication Data

US 2020/0121538 A1 Apr. 23, 2020

Related U.S. Application Data

(63) Continuation of application No. 15/886,826, filed on Feb. 1, 2018, now Pat. No. 10,632,037.

(51) Int. Cl.

| | |
|---|---|
| ***A47C 1/034*** | (2006.01) |
| ***A47C 7/50*** | (2006.01) |
| ***A61G 15/00*** | (2006.01) |
| ***A61G 15/04*** | (2006.01) |
| ***A61G 15/06*** | (2006.01) |
| ***A61G 15/12*** | (2006.01) |
| ***A61G 15/02*** | (2006.01) |

(Continued)

(52) U.S. Cl.

CPC ..... *A61G 15/02* (2013.01); *A61G 13/0018* (2013.01); *A61G 13/02* (2013.01); *A61G 13/06* (2013.01); *A61G 13/08* (2013.01); *A47C 17/162* (2013.01); *A61G 5/006* (2013.01); *A61G 13/125* (2013.01); *A61G 13/1225* (2013.01); *A61G 13/1245* (2013.01); *A61G 15/12* (2013.01); *A61G 2200/34* (2013.01)

(58) Field of Classification Search

CPC ..... A47C 7/506; A47C 7/5062; A47C 7/5066; A61G 15/02; A61G 13/0018

USPC ..... 297/330, 423.26, 423.27, 423.28, 423.3

See application file for complete search history.

(56) References Cited

U.S. PATENT DOCUMENTS 3,753,592 A * 8/1973 Jensen ..... A47C 7/14 297/362.13 X 3,792,905 A * 2/1974 Johnson ..... A61G 15/02 297/330

(Continued)

*Primary Examiner* — Rodney B White

(74) *Attorney, Agent, or Firm* — Duren IP; Todd E. Zenger

(57) ABSTRACT

Examination or procedure tables and chairs which can be moved into positions in more efficient and desirable ways to better meet the needs of the patient and medical service providers. In particular, a plurality of actuators which cause the seat, leg rest and foot rest of the table or chair to move and which may, if desired, be independently programmed to provide mechanically independent movement of the seat, leg rest and foot rest to desirable positions needed to provide ease of entry or transfer by the patient to the equipment including positioning the highest portion of the seat to a home or patient entry position no more than nineteen inches from the floor.

21 Claims, 15 Drawing Sheets

(51) Int. Cl.

| | |
|---|---|
| ***A61G 13/00*** | (2006.01) |
| ***A61G 13/08*** | (2006.01) |
| ***A61G 13/06*** | (2006.01) |
| ***A61G 13/02*** | (2006.01) |
| *A61G 13/12* | (2006.01) |
| *A47C 17/16* | (2006.01) |
| *A61G 5/00* | (2006.01) |

(56) References Cited

U.S. PATENT DOCUMENTS 3,804,460 A * 4/1974 Leffler ..... A61G 15/02 297/330
3,866,973 A * 2/1975 Heubeck ..... A61G 15/02 297/330 X
3,934,928 A * 1/1976 Johnson ..... A61G 15/02 297/330 X
3,984,146 A * 10/1976 Krestel ..... A61G 15/02 297/330
4,168,099 A * 9/1979 Jacobs ..... A61G 15/005 297/330 X
4,250,439 A * 2/1981 Hohmann ..... G05B 19/40 318/568.1
4,336,965 A * 6/1982 Lipp ..... A61G 15/00 297/423.36
4,508,387 A * 4/1985 Gilbert ..... A61G 13/12 297/423.36 X
4,541,671 A * 9/1985 Broadhead ..... A61G 15/02 297/330
4,586,398 A * 5/1986 Yindra ..... A61G 15/02 200/557
4,956,592 A * 9/1990 Schulte ..... A61G 15/02 318/286
5,015,035 A * 5/1991 Stoeckl ..... A61G 15/02 297/330
5,190,349 A * 3/1993 Austin, Jr. ..... A61G 15/02 297/330 X
5,214,360 A * 5/1993 Gonser ..... A61G 15/02 297/330
5,300,926 A * 4/1994 Stoeckl ..... A61G 15/02 345/156
5,340,953 A * 8/1994 Krebs ..... A61G 15/02 297/330 X
5,352,020 A * 10/1994 Wade ..... B60N 2/995 297/423.26
5,467,002 A * 11/1995 Brooks ..... A61G 15/02 297/330 X
5,484,188 A * 1/1996 Stoeckl ..... A61G 15/02 297/408 X
5,628,546 A * 5/1997 Boetzkes ..... A61G 15/02 297/330 X
5,645,313 A * 7/1997 Best ..... A61G 15/02 297/330
5,882,083 A * 3/1999 Robinson ..... A47C 1/0342 297/423.26 X
5,884,350 A * 3/1999 Kurze ..... A61G 15/02 297/330
5,918,942 A * 7/1999 Olsen ..... A47C 1/035 297/423.28 X
6,095,610 A * 8/2000 Okajima ..... B60N 2/995 297/423.36
6,276,012 B2 * 8/2001 Borders ..... A61G 13/0009 5/622
6,382,725 B1 * 5/2002 Carroll ..... A47C 1/0347 297/330 X
6,454,353 B1 * 9/2002 Knaus ..... A47C 1/023 297/423.28 X
6,517,160 B2 * 2/2003 Marcantoni ..... A47C 7/506 297/423.36
6,526,643 B1 * 3/2003 Renault ..... B60N 2/0244 297/423.26 X
6,752,463 B2 * 6/2004 Nivet ..... B60N 2/0224 297/330
6,783,178 B2 * 8/2004 Kasahara ..... B64D 11/0641 297/330 X
6,874,855 B2 * 4/2005 Nivet ..... A47C 1/0242 297/330
6,926,366 B2 * 8/2005 Wolters ..... A61G 13/12 297/423.36
6,929,323 B2 * 8/2005 Enno ..... B64D 11/0641 297/330 X
7,121,627 B2 * 10/2006 Gaikwad ..... A47C 7/506 297/423.28 X
7,322,651 B2 * 1/2008 Makhsous ..... A47C 17/163 297/423.26 X
7,350,249 B2 * 4/2008 Jacobs ..... A61G 13/0018 5/624
7,496,979 B2 * 3/2009 Hempker ..... A61G 15/00 297/423.28
7,887,130 B1 * 2/2011 Zvolena ..... A47C 15/004 297/330 X
7,914,076 B2 * 3/2011 Broering ..... A61G 15/02 297/330
10,632,037 B2 * 4/2020 Baker ..... A61G 13/08
2002/0113478 A1 * 8/2002 Kasahara ..... B64D 11/06395 297/423.3 X
2002/0158497 A1 * 10/2002 Nivet ..... B60N 2/0244 297/330
2005/0077852 A1 * 4/2005 Treon ..... A61G 15/02 318/271
2006/0186721 A1 * 8/2006 Flory ..... B60N 3/063 297/423.36
2007/0289064 A1 * 12/2007 Martin ..... A61G 7/005 5/618
2007/0290468 A1 * 12/2007 Martin ..... A61G 13/08 280/47.38
2009/0049603 A1 * 2/2009 Martin ..... A61G 5/10 5/83.1
2009/0227830 A1 * 9/2009 Pillutla ..... A61N 2/02 600/13
2010/0109407 A1 * 5/2010 Broering ..... A61G 15/02 297/362.13
2011/0025113 A1 * 2/2011 Thoreux ..... B64D 11/064 297/330
2015/0305507 A1 * 10/2015 Besler ..... A47C 7/506 297/423.28
2016/0374476 A1 * 12/2016 Wu ..... A47C 7/5066 297/423.28
2017/0056243 A1 * 3/2017 Schuele ..... A61F 9/0084
2017/0252242 A1 * 9/2017 Young ..... A61G 5/1059
2017/0296416 A1 * 10/2017 Scott ..... A61G 13/04
2018/0085271 A1 * 3/2018 Lim ..... A61B 8/461
2018/0104126 A1 * 4/2018 Paul ..... A61G 15/002

* cited by examiner

PROGRAMMABLE EXAMINATION AND PROCEDURE TABLES AND CHAIRS

This application is a continuation application of and claims filing priority to U.S. patent application Ser. No. 15/886,826 filed Feb. 1, 2018 now U.S. Pat. No. 10,632,037 B2.

BACKGROUND OF THE INVENTION

1. Field of the Invention

The disclosed technology relates generally to medical examination and procedure equipment including tables and chairs. The equipment typically has a surface upon which a patient is placed for the examination or procedure. Parts of the tables and chairs can be moved to different positions to accommodate the needs of the patient and the needs of the medical service provider.

2. Background and Related Art

A wide variety of examination and procedure tables and chairs known in the art require some manual manipulation to orient different parts of the tables and chairs into different positions. Other tables and chairs have one or more interdependent mechanical linkages which are used to orient different parts of the tables and chairs into different positions.

The movement of many different parts of the known tables and chairs is limited resulting in ranges of use and positioning that do not meet many needs of patients and medical service providers. Due to the interdependence of the movements of the known tables and chairs, certain movements and positions cannot be achieved in an efficient or desirable way. The disclosed and claimed technology herein disclosed technology provides examination and procedure tables and chairs with advantageous movement, ranges of motion and positions to meet previously unmet but desired needs of the patient and medical service provider.

SUMMARY OF THE INVENTION

The disclosed technology of the technology presented in this patent relates generally to examination and procedure tables and chairs which can be moved into positions in more efficient and desirable ways to better meet the needs of the patient and medical service providers. For purposes of this patent when the term "chair" is used it refers equally to an examination or procedure chair or table. In particular, a plurality of actuators which can be independently programmed to cause independent, mechanical movement of the seat/seat assembly, leg rest/leg rest assembly and foot rest/foot rest assembly of the disclosed technology to desirable positions needed to provide ease of entry or transfer by the patient to the chair including positioning the highest portion of the seat to a home or patient entry position no more than nineteen inches from the floor.

The programmable movement of the disclosed chairs permits the medical service provider to efficiently and accurately move the patient into positions which provide ergonomically desirable access by the medical service provider to the patient to ensure efficient and competent diagnosis or treatment services taking into account the specific needs of each individual patient.

The programmable and mechanically independent movement of the surface of the seat, leg rest assembly and foot rest of the disclosed technology moves the leg rest and/or foot rest over an increased range of lateral extension and/or positioning to properly support and present the patient for examination or procedure and to provide for the comfort of patients whether tall or short.

Chairs embodying the disclosed technology efficiently and safely move the table or chair from an examination/procedure position to a desired home, entry or other position avoiding any contact of the leg rest or foot rest with the floor during programmable, synchronized, and/or simultaneous movement of different parts of the table/chair. This synchronized and/or simultaneous coordination of movement of the seat assembly, leg rest assembly and foot rest allow the medical service provider to focus on the treatment, comfort and safety of the patient without requiring the medical service provider to select a number of movements in order to have the chair move to the desired positions.

Chairs embodying the disclosed technology eliminate the need of the medical service provider to manually manipulate different parts of the table or chair in order to reach a desired or maximum extension, retraction or other position. Chairs of the disclosed technology eliminate any requirement that the medical service provider manually move a portion of the table or chair such as the leg rest assembly in order to reach its maximum extension or to retract it from a maximum extension. Doing so frees the hands of the medical service provider from touching portions of the chair which may be less clean or which are subject to a less clean environment. By eliminating any manual manipulation of chair parts the medical service provider frees time to provide the needed examination or procedure services without the inconvenience of stopping, delaying or interrupting the examination or procedure to manually position the chair.

Chairs embodying the disclosed technology comprise a plurality of programmably controlled actuators used to cause a variety of movements of the seat assembly, leg rest assembly and/or foot rest to the desired positions wherein the plurality of movements occurs synchronized, simultaneously and/or mechanically independent of each other.

Implementations of the disclosed technology take place in association with other independent movement of other parts of the chair including a head or face rest, a back rest hinged to the seat or transfer surface, arm other limb rests, etc. Such chairs also comprise a base having means for raising and lowering the seat and other means for moving the parts of the chair into desired configurations, such as into a reclined position, an upright position, a semi-reclined position or other positions desired by the medical service provider.

These and other features and advantages of the disclosed technology will be set forth or will become more fully apparent in the description that follows and in the appended claims. The features and advantages may be realized and obtained by employing the disclosure of this patent and as particularly pointed out in the appended claims and their equivalents. Furthermore, the features and advantages of the disclosed technology may be learned by the practice of it or will be obvious from the description, as set forth hereinafter.

BRIEF DESCRIPTION OF THE DRAWINGS

In order that the manner in which the above referenced and other features and advantages of the disclosed technology are achieved, a more particular description of the invention will be rendered through reference to exemplary embodiments illustrated in the appended drawings. It will be appreciated by one of skill in the art that the following descriptions and drawings depict only exemplary embodiments of the disclosed technology and are not, therefore, to be considered as limiting in scope. Therefore, the disclosed technology is described and explained with additional specificity and detail through the use of the accompanying drawings in which.

DETAILED DESCRIPTION OF THE INVENTION

The disclosed technology relates generally to medical chairs, and more specifically, to combinations of movements of parts of the chair such as a seat assembly, leg rest assembly and/or foot rest which can be moved to desired locations using independently programmed and/or synchronized actuators.

Figure 1:
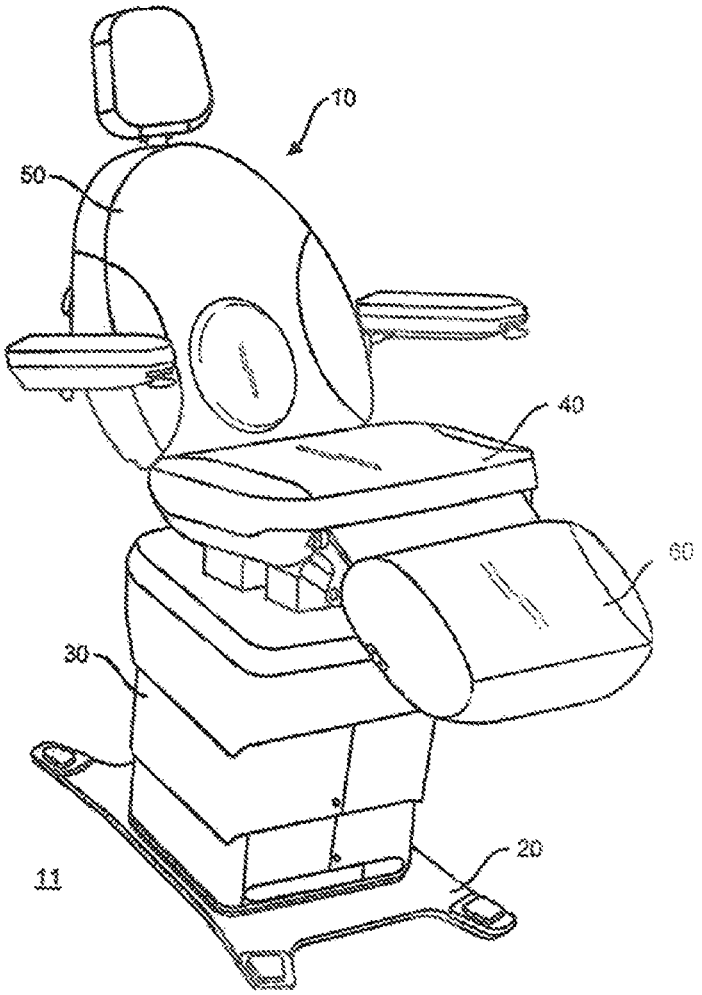
FIG. 1 is a perspective view of an examination chair in accordance with a representative embodiment of the disclosed technology.
Figure 7:
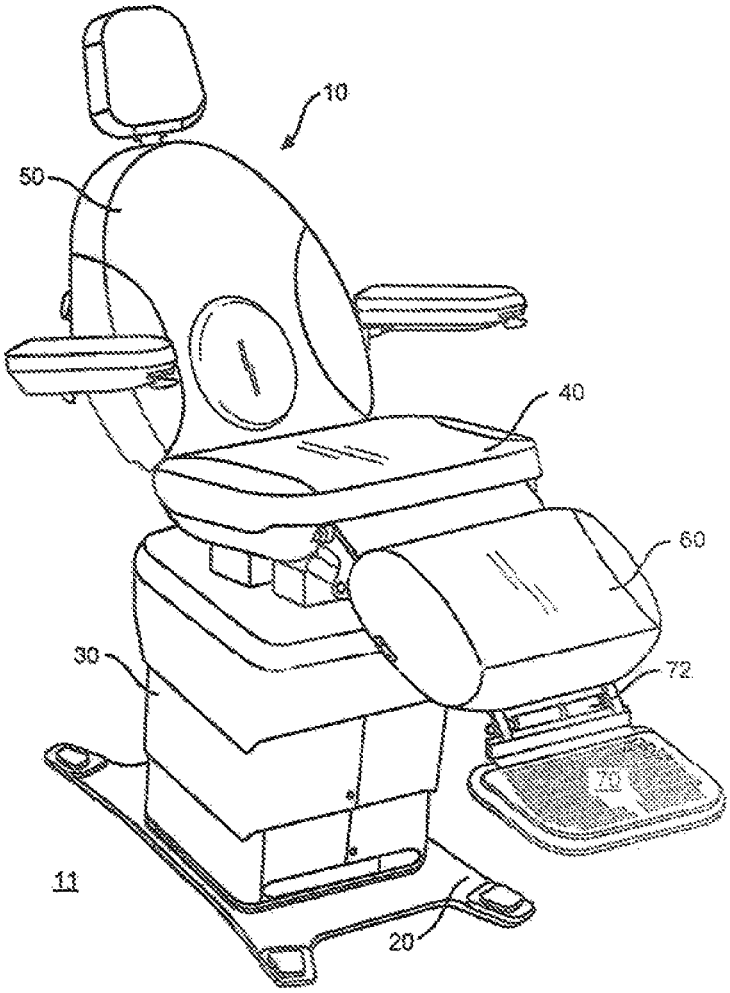
FIG. 7 is a perspective view of an examination chair including a foot rest in accordance with another representative embodiment of the disclosed technology.

As shown in FIGS. 1 and 7 chair/table 10 comprises various components as situated on floor 11. Chair 10 comprises a base 20, a lift lifting column or system 30, a seat assembly 40, a back rest 50, a leg rest assembly 60 and/or foot rest 70. These components will be described in further detail in the subsequent figures and descriptions.

Figure 2:
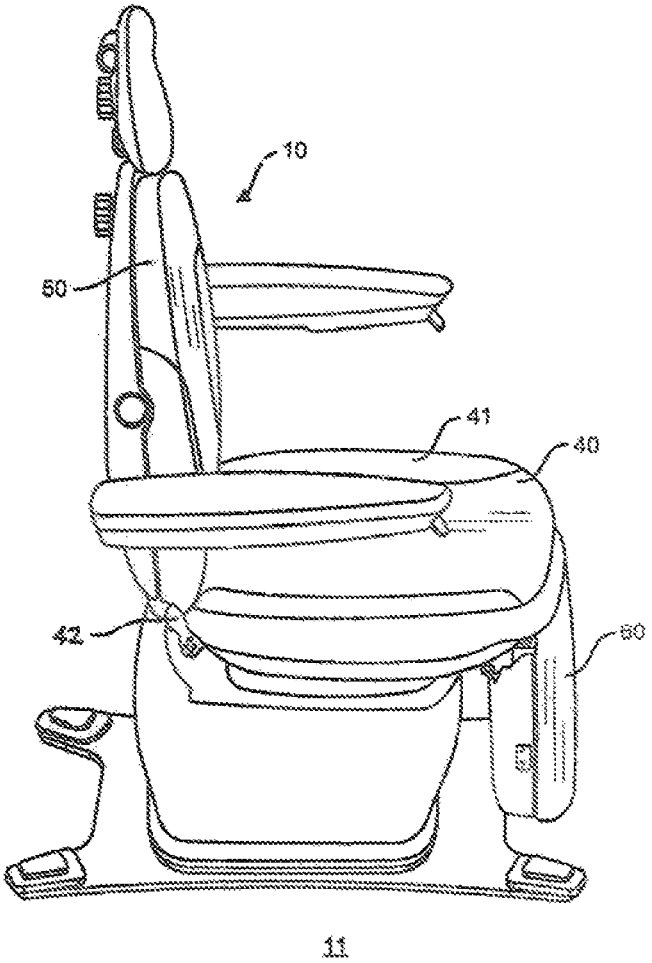
FIG. 2 is a view of an examination chair shown in a patient entry position in accordance with a representative embodiment of the disclosed technology.

The chair 10 is shown in FIG. 2 in an entry or patient entry position. That is, seat assembly 40 is lowered to height to permit the patient to transfer to chair 10. Seat assembly or seat 40 assembly comprises a seat framework 42 (FIG. 6) and a upper surface for supporting a patient, the upper surface having one or more contours defining a highest vertical point 41 of seat assembly 40. The upper surface of seat assembly 40 is typically cushioned for patient comfort. The highest vertical point 41 of seat 40 may be located anywhere on the uncompressed, upper surface of seat 40. The embodiments of the disclosed technology are capable of having the highest point 41 of seat assembly 40 lowered to a distance no greater than nineteen inches from floor 11. For purposes of this patent, this entry or transfer height of the highest point 41 of seat assembly 40 at no more than nineteen inches from the floor 11 will be known as the patient entry position or transfer surface height.

As shown in FIG. 2, when the chair 10 is moved to the patient entry position, the back rest 50 is shown substantially upright, the seat 40 is substantially horizontal and the leg rest assembly or leg rest 60 is retracted adjacent seat 40 into a substantially vertical position. Back rest 50 comprises a patient support surface which is also typically cushioned for patient comfort. Leg rest 60 comprises a leg rest assembly framework 65 and a patient support surface. The patient support surface of leg rest 60 is also typically cushioned for patient comfort. The same can be true for the chair shown in FIG. 7. In an alternative arrangement of the chair of FIG. 2, back rest 50 can be in a reclined position in the patient entry position.

Figure 3:
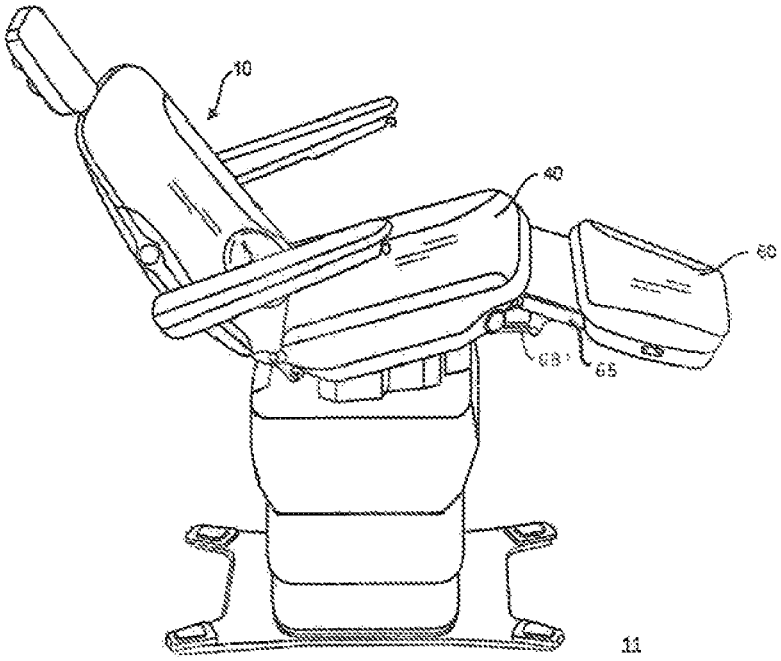
FIG. 3 is a view of an examination chair shown in transition between a patient entry position and an examination position in accordance with a representative embodiment of the disclosed technology.
Figure 4A:
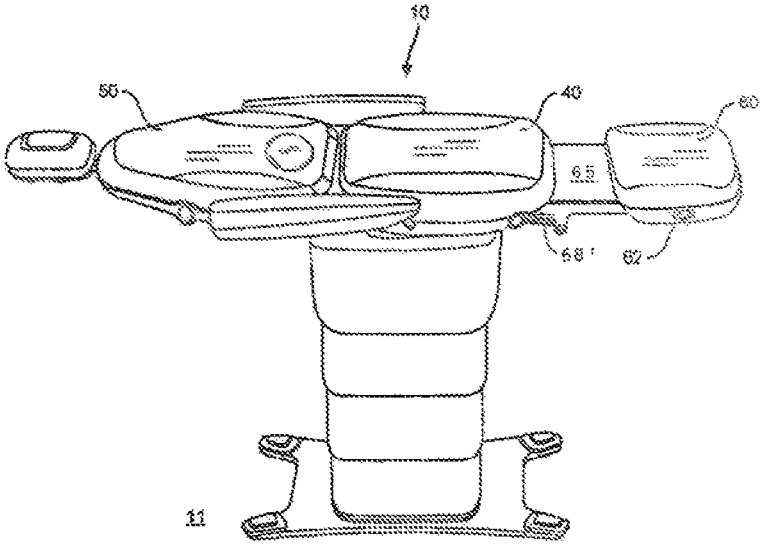
FIG. 4A is a view of an examination chair shown in an examination position with the leg rest assembly extended in accordance with a representative embodiment of the disclosed technology.

FIG. 3 depicts chair 10 in a transition position between the patient entry position and an elevated or raised examination position (shown in FIG. 4A). As shown in FIG. 3, seat 40 has been raised a further distance from floor 1 land inclined, as desired, with inclined seat back 50 and raised and extended leg rest 60.

One feature of the disclosed technology includes an advantageous mechanism for extending and retracting leg rest 60. The disclosed technology includes means for programmably extending and retracting leg rest 60 independent of other movement of parts of chair 10. The nature of programmably moving leg rest 60 being mechanically independent of other movement of the chair will be discussed below.

FIG. 4A depicts chair 10 having been raised to an examination position. Examination position can be any position selected by the medical service provider. As shown by way of example in FIG. 4A, seat 40 has been raised a distance from floor 11. In this view, the seat 40 remains substantially horizontal and back rest 50 has also been reclined to a substantially horizontal position. Leg rest 60 has been raised to a substantially horizontal position and leg rest 60 has been extended a distance away from seat 40.

Figure 5:
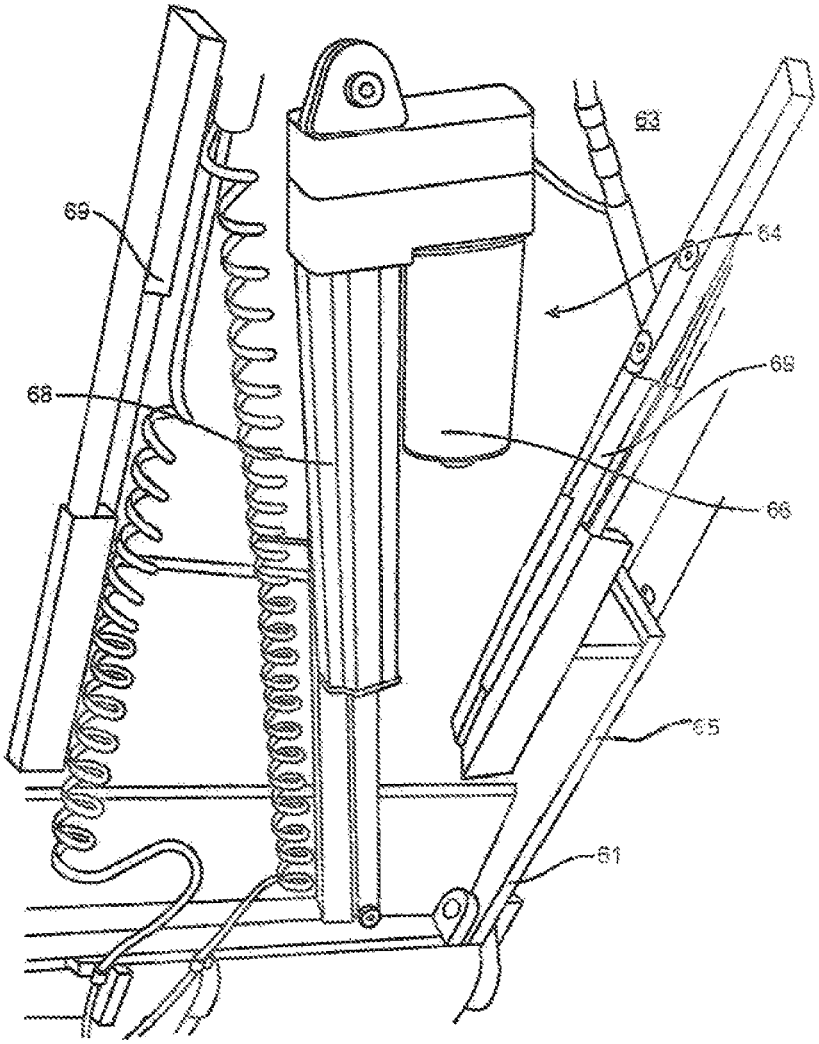
FIG. 5 is a partial view of an actuator of the leg rest assembly in an extended position in accordance with a representative embodiment of the disclosed technology.

Another aspect of the disclosed technology is illustrated in FIG. 4A. Extension of leg rest 60 away from seat 40 may be accomplished by actuation instructions programmed into electronic components of chair 10 or by use of switch 62 which can be touched by the medical service provider to selectively move leg rest 60 toward or away from seat 40, or by other switches such as a hand control, foot control or other programmable function. This extension and retraction of leg rest 60 can be accomplished independent of and mechanically independent of any other movement of chair 10. This mechanically independent extension and retraction of leg rest 60 is accomplished using a parallel shaft actuator 64 as depicted in FIG. 5. A variety of parallel shaft actuators are known to those skilled in the art. The advantageous use of leg rest parallel shaft actuator 64 includes having a compact actuator including a motor 66 and a spindle 68. A novel aspect of the disclosed technology is positioning actuator 64 within leg rest 60 allowing the spindle 68 to extend to a desired length to move leg rest 60 the desired distance from seat 40, preferably up to seven inches or more in distance. The range of extension of actuator 64 depends upon the size of the space within leg rest 60 and the size and orientation of actuator 64 positioned in leg rest 60. The operation of leg rest actuator 64 to move leg rest 60 to the desired position is independently programmable and functions mechanically independent of any other movement of the chair 10.

Figure 4B:
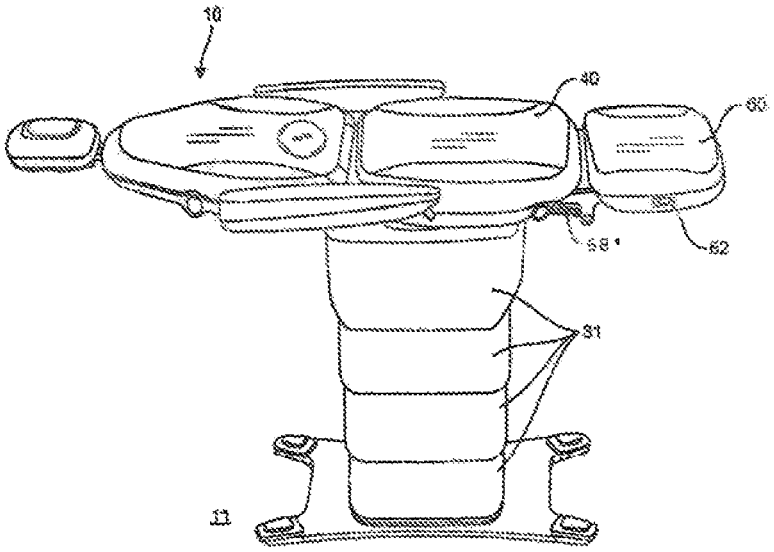
FIG. 4B is a view of an examination chair shown in an examination position with the leg rest assembly retracted in accordance with a representative embodiment of the disclosed technology.

FIG. 4B depicts chair 10 in an alternative examination position with leg rest 60 retracted or moved laterally closer to seat 40. This movement is also accomplished by actuation instructions programmed into electronic components of chair 10 or by the medical service provider selecting the direction of lateral movement of leg rest 60 using switch 62 or other switches such as a hand control, foot control or other programmable function. The advantage of leg rest actuator 64 provides the medical service provider with the ability to uniquely customize the position of leg rest 60 relative to seat 40 to accommodate the individualized size or comfort of each patient and to provide the medical service provider with the ability to support or position the patient in a way that allows the medical service provider to have the necessary access to the patient or to place the patient in an ergonomically desired position for the examination or procedure. Use of leg rest actuator 64 via leg rest switch 62, a hand control, foot control or other programmable function permits the medical service provider to select a custom position individualized for each patient and treatment independent of other mechanical movement of chair parts such as the seat 40, back 50 or base 30. Use of leg rest actuator 64 via programmed instructions, switch 62 or other switches allows leg rest 60 to be controlled over its entire range of motion and eliminates any need of the medical service provider to manually push or pull on leg rest 60 to achieve the desired extension.

As shown in FIG. 5, leg rest actuator 64 is disposed within leg rest 60 by connecting shaft spindle 68 to a proximal end 61 of leg rest 60 adjacent seat 40. The other end of leg rest actuator 64 is connected to a distal end 63 of leg rest 60. By utilizing commonly available guide-slide support structures 69, leg rest 60 may be extended or retracted along guide-slide 69 by causing parallel shaft actuator 64 to extend or retract spindle 68. One of skill in the art will understand that the orientation of actuator 64 can be reversed to achieve the equivalent movement of leg rest 60 by having spindle 68 attach to the distal end 63 of leg rest 60 and the other end of actuator 64 connect to the proximal end 61 of leg rest 60.

Figure 6:
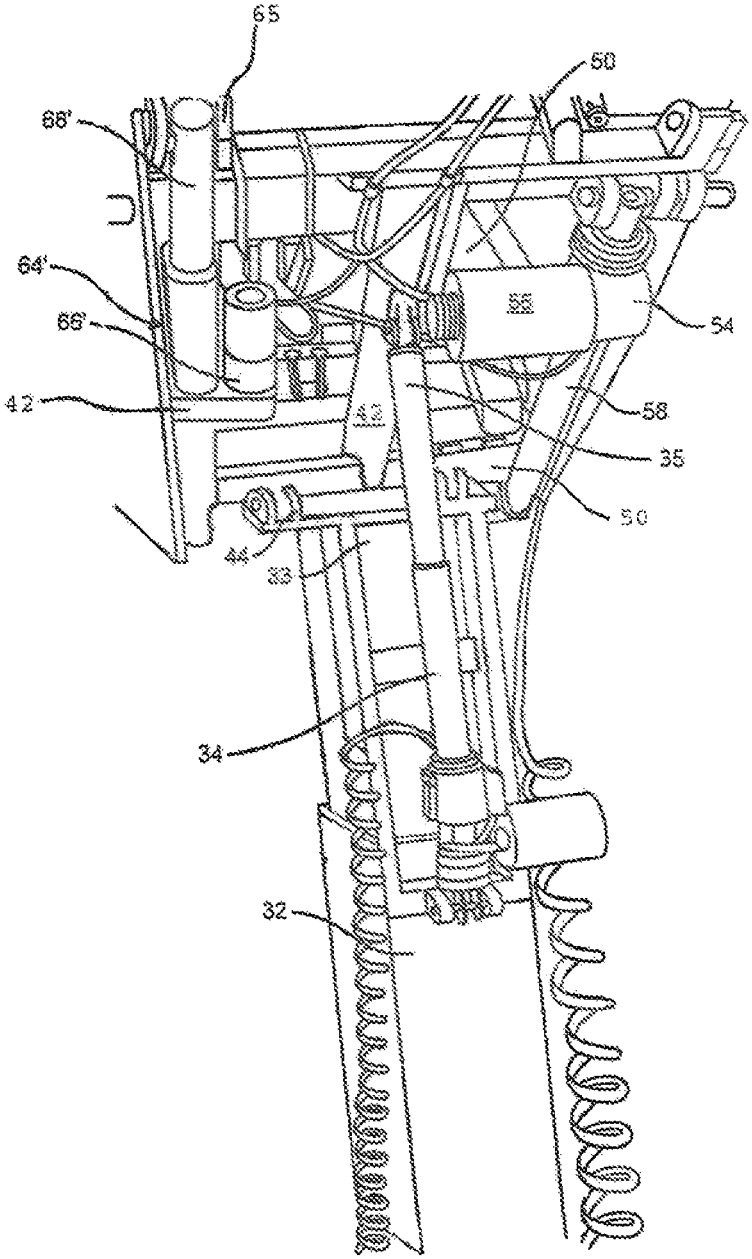
FIG. 6 is a view of actuators connected to the seat assembly in accordance with a representative embodiment of the disclosed technology.

The disclosed technology also contemplates raising leg rest 60. For example as shown in FIGS. 3, 4 and 6 a second leg rest actuator 64' raises leg rest 60 at least approximately ninety degrees relative to the orientation of seat 40; from a substantially vertical to a substantially horizontal position. Second leg rest actuator 64' is depicted in FIG. 6. Second leg rest actuator 64' is connected to framework 42 of seat 40. Second leg rest actuator 64' comprises a motor 66' and a spindle 68'. Spindle 68' is attached to framework 65 of leg rest 60 at end 61. By programmably causing second leg rest actuator 64' to extend spindle 68' leg rest 60 can be raised, for example, from its substantially vertical position as shown in FIG. 2 to a substantially horizontal position as shown in FIG. 4A. Conversely, leg rest 60 can be lowered from an examination position to the patient entry position by causing spindle 68' to retract. Second leg rest actuator 64' may be independently programmable and operates mechanically independent of any other movement of the chair 10. Raising and lowering foot rest 60 may be accomplished using a button on the chair, a hand control or foot control as known by those skilled in the art. The advantage of having leg rest actuator 64 and second actuator 64' both independently programmable and mechanically independent of any other motion of chair 10 allows the movement of leg rest actuator 64 and second leg rest actuator 64' to be programmably controlled for independent, synchronized simultaneous operation, if desired, allowing the medical service provider to position leg rest 60 in the desired position relative to seat 40 without requiring the medical service provider to manually manipulate leg rest 60. Further advantages of the independent programmability and mechanically independent motion of leg rest 60 will be explained below in connection with returning chair 10 from a raised examination position to a patient entry position.

Lifting system 30, comprises a telescoping housing 31 as shown in FIG. 4B. As lifting system 30 raised or lowers seat 40, telescoping housing 31 lengthens or shortens to accommodate the height of seat 40 from floor 11. The raising and lowering of seat 40 is accomplished by raising and lowering seat framework 42 using a vertical lift actuator or column 32 as depicted in FIG. 6. A variety of vertical lift actuators are known to those skilled in the art. Lift actuator 32 is also independently programmable and can be controlled and moved mechanically independent of any other parts of chair 10. One of ordinary skill in the art will appreciate that the selection of lift column 32 and its specifications will determine the range of motion of lift column 32.

Seat 40 may also be inclined as desired by the medical service provider. This is accomplished using inclination actuator 34 depicted in FIG. 6. As depicted in FIG. 6, a right angle actuator 34 is mounted or disposed relative to lift column 32 such that distal end 35 of inclination actuator 34 is connected to framework 42 of seat 40. Seat 40 is hingedly connected to seat back 50 at hinge 44. When inclination actuator is extended or retracted seat 40 rotates about hinge 44 causing seat 40 to selectively achieve the inclination desired by the medical service provider. Seat inclination actuator 34 is independently programmable and operates mechanically independent of any other part of the chair 10. By mounting seat inclination actuator 34 to distal end 33 of lift column 32 the selected inclination of seat 40 remains constant upon motion of lift column 32.

As shown in FIGS. 2, 3 and 4, back rest 50 may also rotate about hinge 44 to vary its relative inclination to seat 40. This is accomplished using a back rest actuator 54 comprising motor 56 and spindle 58 as shown in FIG. 6. Depicted in FIG. 6 is a right angle actuator 54 connected to seat framework 42 and to back rest 50. Actuating back rest actuator 54 causes its corresponding spindle 58 to extend or retract causing back rest 50 to rotate about hinge 44. Hence, the inclination of back rest 50 can be selected by the medical service provider. Back rest actuator 54 is independently programmable and operates mechanically independent of other parts of chair 10. This allows back rest actuator 54 to be utilized independent of any other motion of the chair or used in a synchronized and/or simultaneous way with any of the other actuators of chair 10.

Figure 8:
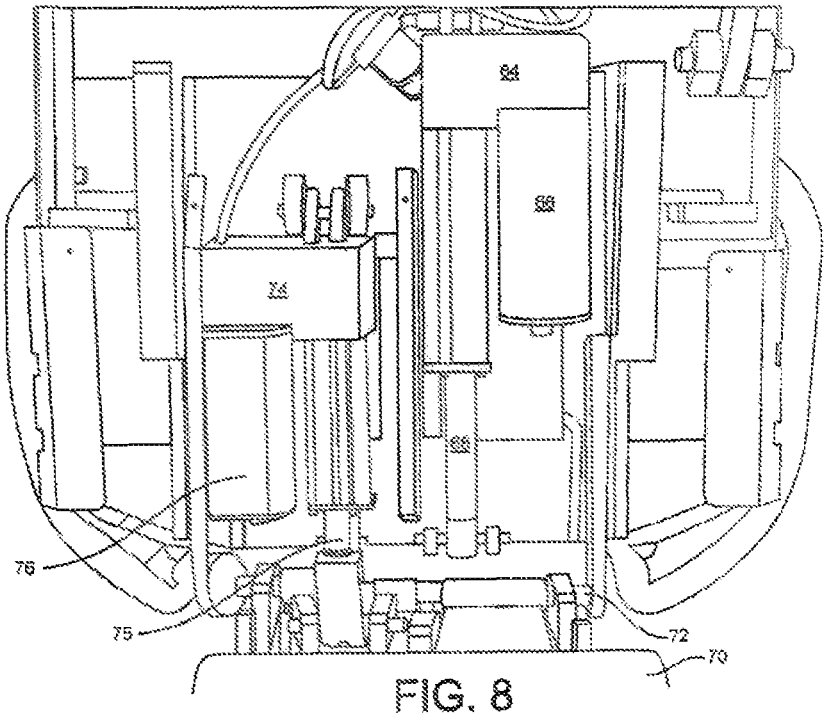
FIG. 8 is a view of the actuators of an examination chair including a foot rest in accordance with another representative embodiment of the disclosed technology.

The disclosed technology also contemplates a foot rest 70 as illustrated in FIG. 7. Foot rest 70 may be hingedly connected to leg rest 60 about hinge 72. The angular orientation of foot rest 70 relative to leg rest 60 may be selected by the medical service provider. In a preferred embodiment, the angular orientation of foot rest 70 is achieved using a programmably controlled actuator. For example, as shown in FIG. 8 an alternative embodiment of foot rest 60 is illustrated. In FIG. 8 leg rest actuator 64 is positioned in such a way to permit a foot rest actuator 74 to also be disposed under leg rest 60. Foot rest actuator 74 comprises a motor 76 and a spindle 78. Spindle 78 is connected to foot rest 70 such that when foot rest actuator 74 is actuated spindle 78 extends to rotate foot rest 70 about hinge 72. This allows chair 10 to position foot rest 70 at various angular orientations relative to leg rest 60. The advantage of these varying orientations of foot rest 70 will be indicated below. Like the other actuators discussed above, foot rest actuator 74 is independently programmable and can cause foot rest 70 to move mechanically independent of any other parts of chair 10.

Figure 9A:
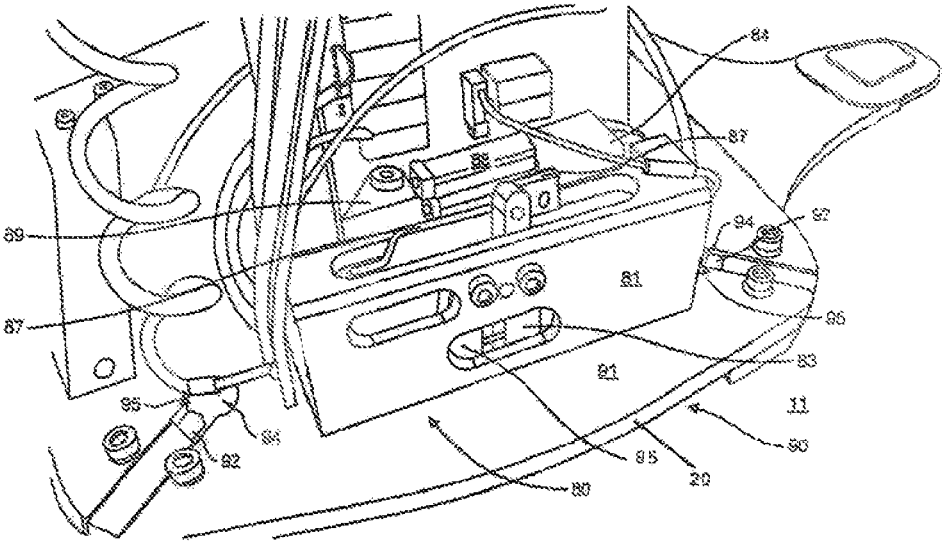
FIGS. 9A and 9B are depictions of components of a swivel lock system of an examination chair in accordance with a representative embodiment of the disclosed technology.
Figure 9B:
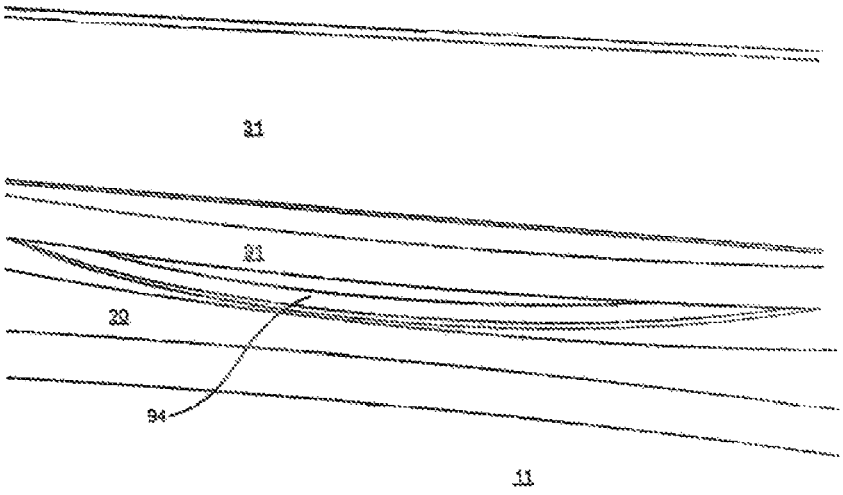

The disclosed technology also contemplates a chair swivel system 90 and a swivel lock system 80. As shown in FIG. 9A swivel system 90 comprises a platform 91 and, as further shown in FIG. 9B, a swivel disc 94. Platform 91 is positioned a distance away from disc 94 leaving a gap between platform 91 and disc 94. Disc 94 is fixed to base 20. Substantially central to disc 94, and substantially axial of lift column 32, platform 91 is permitted to rotate above disc 94. In a preferred embodiment, the combined vertical thickness of platform 91, the vertical gap between platform 91 and disc 94 and the vertical thickness of disc 94 is approximately one inch or less.

Platform 91 defines an opening 95 in which a cam follower bearing 92 is mounted to permit platform 91 to rotate on disc 94; cam follower bearings 92 maintain the gap between swivel disc 94 and swivel platform 91. As shown in further detail in FIG. 9B, base 20 hosts swivel disc 94.

FIGS. 9A, 10A and 10B and 10C depict an embodiment of a swivel lock system 80 contemplated by the disclosed technology. Swivel lock system 80 comprises a housing 81. Adjacent housing 81 is a swivel lock actuator 84. Actuator 84 is a parallel shaft actuator like those described above. Swivel lock actuator 84 drives a spindle component 88 to which is connected a spindle connector 89. Spindle connector 89 is further connected to vertical plate 87 disposed within housing 81 such that when swivel lock spindle 88 is extended or retracted swivel connector 89 is likewise extended or retracted thereby moving plate 87 in corresponding lateral directions as suggested by arrow A and arrow B shown in FIG. 10A.

Swivel lock system 80 further comprises legs 83 and 85. Leg 83 rotates within housing 81 around plug 183. Leg 85 rotates within housing 81 around plug 185. Leg 83 is coupled to leg 85 by a spring 82. In the repose, locked position, plate 87 is positioned by actuator 84 such that raised portion 87' of plate 87 does not engage leg 83 because plate 87 has been moved in the direction shown by arrow B in FIG. 10A. The repose position of legs 83 and 85 is achieved by spring 82 which draws leg 83 and leg 85 toward each other. In their locked position, the face or distal end 83' of leg 83 and/or distal end 85' of leg 85 contact disc 94. The face of distal end 83' and/or distal end 85' are preferably slightly rounded or convex to ensure a point of contact with swivel disc 94. The contact faces of leg 83 and 85 are slightly convex to provide a continual, angular point of contact between legs 83 and/or 85 and disc 94. That is, the centroid and radius of the convex feature of legs 83 and/or 85 are strategically positioned such that, when the gap between platform 91 and disc 94 increases or decreases due to slight variations in the thickness of disc 94, the angle created between a line formed from the center of plug 183 (or 185) to the point of contact at 83' (or 85') and the surface of disc 94 remains constant, preferably ranging between 80° and 82°, thus allowing the lock to function correctly in spite of slight variations in the thickness of disc 94 within acceptable tolerances. With strategically shaped convex contact faces, the change in orientation of the contact faces relative to disc 94 does not change the resultant force vector angle, and results in no loss of performance of the lock system.

The friction and/or resistance between disc 94 and the contact faces of distal end 83' and/or distal end 85' cause platform 91 and disc 94 to remain in a fixed relation to each other preventing platform 91 from rotating or swiveling above base 20 and disc 94. This fixed and stationary position is typically the preferred non-swivel or locked position of the chair when a medical service provider is examining or conducting a procedure on the patient. That is, the medical service provider does not normally want the chair rotating during a medical examination or procedure.

Figure 10A:
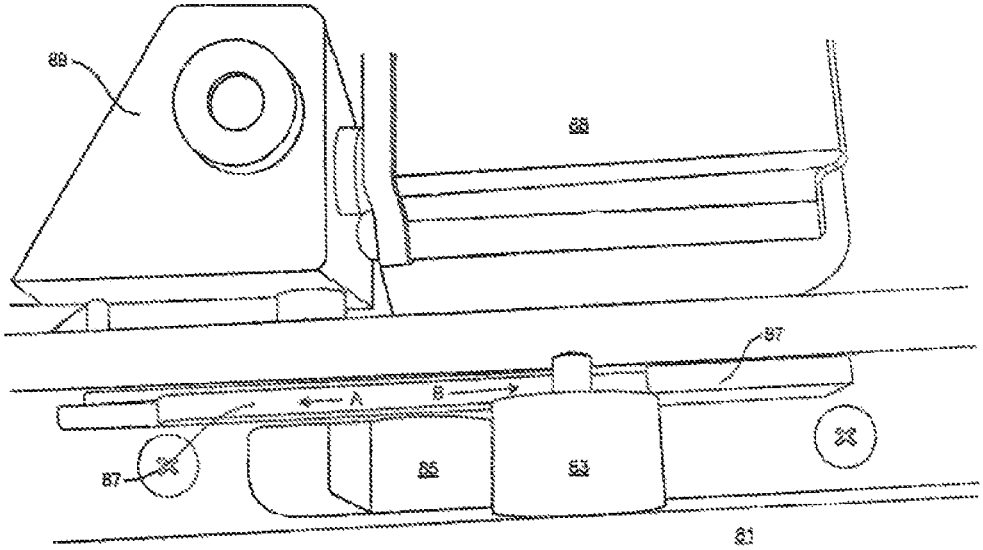
FIGS. 10A, 10B and 10C are further detailed depictions of components of a swivel lock system of an examination chair in accordance with a representative embodiment of the disclosed technology.
Figure 10B:
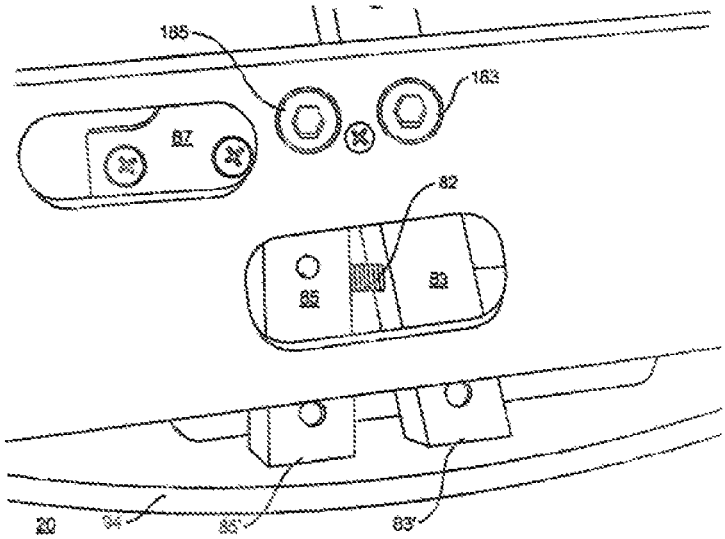
Figure 10C:
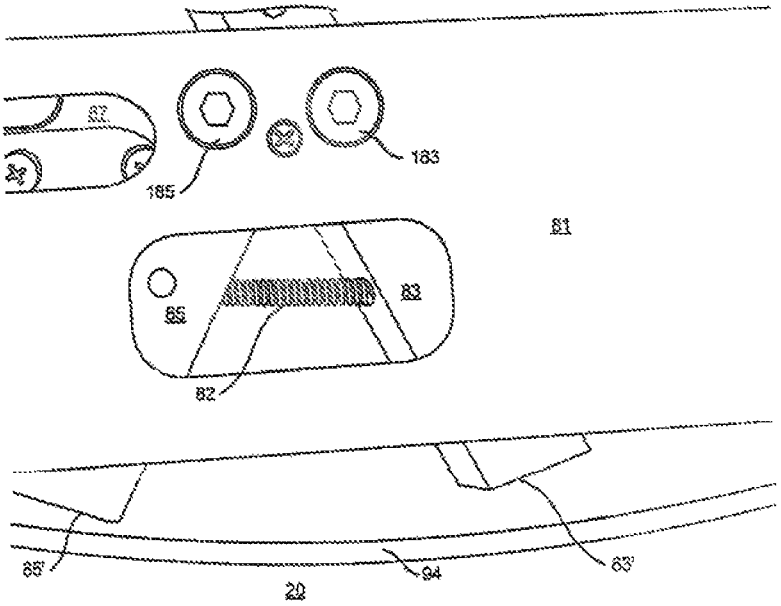

However, when the medical service provider does desire chair 10 to swivel the swivel lock system 80 may be disengaged. This is accomplished by actuating swivel lock actuator 84 causing spindle 88 and spindle connector 89 to move plate 87 in the direction of arrow A in FIG. 10A. As shown in FIG. 10A, as plate 87 moves in the direction of arrow A, plate raised portion 87' engages leg 83 and rotates it about plug 183 and also causes leg 85 to rotate about plug 185 thereby spreading distal ends 83' and 85' away from each other thereby moving leg 83 and 85 away from contact with swivel disc 94 within the gap between swivel disc 94 and swivel platform 91 as illustrated in FIG. 10C. When leg 83 and leg 85 are in the position shown in FIG. 10C, that is, leg 83 and leg 85 are no longer in contact with swivel disc 94, chair 10 mounted on platform 91 is permitted to swivel as desired by the medical service provider. In a preferred embodiment this open or swivel position is temporary and preferably programmably limited to a set period of time after which set time legs 83 and 85 return to their repose or locked position drawn together again by spring 82 as plate 87 moves in the direction of arrow B in FIG. 10A. It is also contemplated that configuration of the programmable chair would permit the chair to remain in an unlocked state until the user elected to reinstate the swivel lock through use of a common swivel lock switch.

Figure 11:
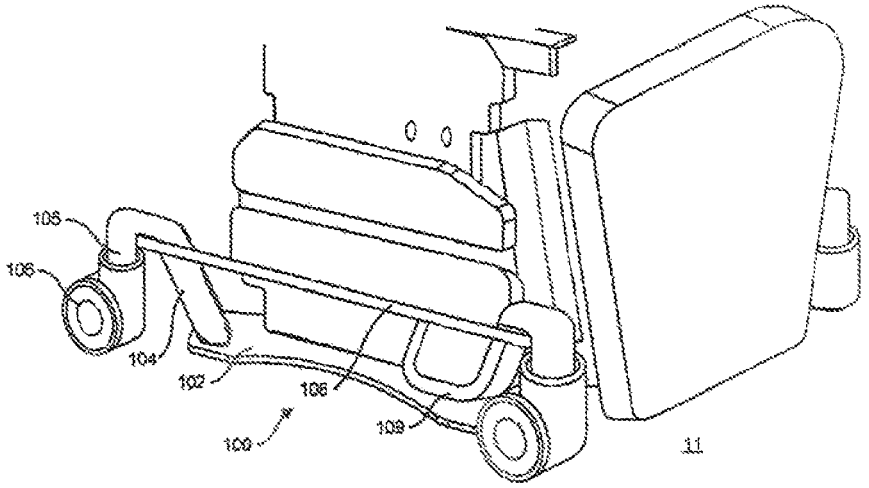
FIG. 11 depicts a mobility system of an examination chair in accordance with a representative embodiment of the disclosed technology.

The disclosed technology also contemplates a chair mobility system 100 as shown in FIG. 11. Mobility system 100 comprises a carrier platform 102 to which are connected a plurality of inverted v or u shaped wheel supports 104. Wheel supports 104 allow wheel 106 to be disposed thereon. Control lever 108 may be rotated using handle 109 to cause the wheel(s) 106 to lock preventing further movement of the mobility system. The advantage of using mobility system 100 permits the medical service provider to position the chair in various locations in the examination room or elsewhere, or permits the medical service provider to move the chair when a patient is in the chair. Other configurations of low profile carrier platforms with wheel assemblies are known in the art.

The disclosed technology provides the advantage of a chair comprising a combination of a seat or patient surface, a seat/patient surface lifting system, a swivel system, a swivel lock system and a base such that the highest point 41 of seat 40 may be positioned no higher than nineteen inches from floor 11 by using unique combinations of independently programmable actuators which cause chair parts to move mechanically independently.

The disclosed technology also provides the advantage of a chair comprising a combination of a seat, a seat/patient surface lifting system, a base and a chair mobility system such that the highest point 41 of seat 40 may be positioned no higher than nineteen inches from floor 11.

As used in this patent, the terms independently programmable and independent programmability mean that each respective actuator is given distinct electronic signals from an electronic source such as a circuit board as to when and how the actuator is to operate. One of skill in the art knows how to generate such signals using a circuit board. The independently programmable nature of the lift actuator, the seat inclination actuator, the seat back inclination actuator, the leg rest rotation actuator, the leg rest extension actuator, the foot rest rotation actuator and the swivel lock actuator permit chair 10 to be manipulated to ensure that the highest point 41 of seat 40 may be moved to a position no more than nineteen inches from floor 11 from any position without requiring the medical service provider to manually manipulate any portion of the chair. Also, the independently programmable nature of the lift actuator, the seat inclination actuator, the seat back inclination actuator, the leg rest rotation actuator, the leg rest extension actuator, the foot rest rotation actuator and the swivel lock actuator permit seat 40, back rest 50, leg rest 60 and foot rest 70 to be moved to the desired examination or procedure position needed by the medical service provider independent of the movement of each other. This provides the medical service provider a limitless variation of relative positions of seat 40, seat back 50, leg rest 60 and foot rest 70. Because there are no interdependent mechanical linkages required between seat 40, back rest 50, leg rest 60 and foot rest 70, the variable positions of each of these parts of chair 10 may be independently controlled. Further, depending upon the selection of leg rest actuator 64, leg rest 60 may be extended to a distance needed or desired by the medical service provider without requiring the medical service provider to manually extend or retract leg rest 60 by pulling or pushing it.

In another alternative combination of chair parts, if desired, an interdependent mechanical linkage may be used between back rest 50 and leg rest 60 to raise and lower leg rest 60, not shown. In such a combination, a back rest actuator would not only incline back rest 50 but through an interdependent mechanical linkage cause the raising and lowering of leg rest 60.

Another important feature of the disclosed technology that provides advantages over the known prior art also derives from the independently programmable and mechanically independent movement of different parts of chair 10. For example, when seat 40 has been raised to an examination height or inclination, leg rest 60 may be extended 3-7 inches, or to whatever range of motion leg rest actuator 64 is a capable of providing. Or, seat 40 may be inclined forward. In either chair position, if the medical service provider desires to have chair 10 then return to the patient entry position no higher than nineteen inches from the floor, the position of leg rest 60 and/or foot rest 70 need to be controlled so that they do not contact floor 11 or trap something between leg rest 60 and/or foot rest 70 and the floor. The disclosed technology provides a chair which programmably controls the relative position of leg rest 60 and/or foot rest 70 from contacting the floor while moving chair 10 from a raised position to a patient entry position. This is achieved through the preparation and execution of executable computer code to independently send actuation signals to a plurality of actuators to mechanically and independently direct the movement of the actuators which control the relative position of seat 40, leg rest 60 and foot rest 70. One of ordinary skill in the art knows how to prepare computer executable code or programs that sense and monitor the extension, retraction and relative position of actuators used to move the different parts of chair 10. Such executable computer code can send distinct actuation signals to a plurality of actuators such that the plurality of actuators operate independently, synchronized and/or simultaneously to bring seat/patient surface 40 from a raised to the patient entry position.

For example, when chair 10 is in the examination position shown in FIG. 4A with leg rest 60 fully extended, leg rest actuator 64 can operate to decrease the extension of leg rest 60 toward seat 40 while simultaneously a second leg rest actuator 64' lowers leg rest 60 from a substantially horizontal to a substantially vertical position in programmable sequences and/or rates of time or movement which prevent leg rest 60 from contacting the floor before the highest point 41 of seat 40 is returned to the patient entry position not higher than nineteen inches from the floor.

The advantage of using independently programmable actuators allows one or more actuators operating simultaneously or in synchronization to be programmed to temporarily pause certain movement of the chair while one or more other actuators cause other movement of the chair. For example, if chair 10 is in a raised, inclined examination position with leg rest 60 fully extended and the user directs chair 10 to return to the patient entry position, a lift, seat inclination and leg rest actuator may simultaneously begin movement of different parts of chair 10. However, actuators such as a lift actuator and/or a seat inclination actuator may need to be temporarily paused from further lowering the seat to first allow a leg rest actuator to sufficiently reduce the leg rest extension to prevent the leg rest from contacting the floor. As a result, with the touch of a button, chair 10 can be moved from a raised and/or inclined examination position with full extension of the leg rest to the patient entry position without any further control input or manual manipulation of the chair by the medical service provider.

Similarly, if chair 10 is in the patient entry position and the user directs chair 10 to move to a raised and/or inclined examination position with the leg rest extended, it may be necessary or desirable to temporarily pause the leg extension actuator to first allow a lift or seat inclination actuator to position the chair such that actuation of the leg rest actuator does not cause the leg rest to contact the floor. These types of chair movement can be done programmably by monitoring or detecting the deployment history of the actuators which alter the position, height and extension of the different parts of chair 10.

Another feature of the disclosed technology is the programmable nature of controlling foot rest 70. When chair 10 is in its patient entry position and when chair 10 also comprises a foot rest 70, leg rest 60 is substantially vertical and foot rest 70 is typically positioned substantially parallel to floor 11, that is, at a right angle to leg rest 60. For examination, chair 10 may be raised and/or inclined into an examination position. The advantage of using independently programmable actuators allows the rotation of foot rest 70 about hinge 72 to be independently controlled to meet the needs of the medical service provider and/or to provide for the comfort or safety of the patent.

For example, the timing and sequence of the rotation of foot rest 70 about hinge 72 can be independently programmable. Use of an independently programmable foot rest actuator 74 permits the rotation of foot rest 70 about hinge 72 to be controlled independent of the mechanical movement of leg rest 60. Thus, if it is desired to maintain foot rest 70 at a right angle relative to leg rest 60, regardless of the lowered or raised position of leg rest 60, actuator 74 is not actuated. However, if it is desired to rotate foot rest 70 about hinge 72, the timing, sequence and/or rate of actuation of foot rest actuator 74 causing that rotation may be programmably controlled to permit and/or limit the rotation of foot rest 70 about hinge 72 as desired thereby meeting the particularized needs of the medical service provider or the particularized comfort or safety of the patient. For example, it may be desirable to not rotate foot rest 70 until leg rest 60 has been raised to a particular inclination. Unlike the prior art, the disclosed technology provides this kind of independent control of the rotation of foot rest 70.

Further, with leg rest 60 in the raised position with foot rest 70 positioned substantially horizontally as illustrated in FIG. 7, if leg rest 60 is lowered without rotating foot rest 70, foot rest 70 may strike the floor. However, the advantages of the disclosed technology in this patent avoid such an occurrence. Because the deployment history of foot rest actuator 74 can be monitored, typically through encoder feedback to the computer, The operation of the other actuators of chair 10 may be synchronized, selectively and/or temporarily paused or slowed to permit actuator 74 to rotate foot rest 70 toward leg rest 60 sufficiently to avoid hitting the floor. This may involve pausing actuation function or varying the rate of operation of the actuation function of the other actuators. For example, any actuator which causes seat 40 to be lowered may be paused to first allow foot rest actuator 74 to properly rotate foot rest 70 to a safe position. Or, the rate of actuation of any actuator used to lower seat 40 may be reduced or varied while the rate of actuation of foot rest actuator 74 is held constant, increased or otherwise varied as needed to rotate foot rest 70 to avoid foot rest 70 from hitting the floor. The ability of the disclosed technology to independently control the rotation of foot rest 70 in these ways is not known in prior art.

The independently programmable and mechanically independent combination of the operation of actuators 32, 34, 54, 64, 64' and 74 of the disclosed technology permit the medical service provider to readily, efficiently, safely, and accurately control the relative movement of the parts of chair 10. The independently programmable and mechanically independent combination of the operation of actuators 32, 34, 54, 64, 64', and 74 permit the medical service provider to readily, efficiently, safely, and accurately maintain examination positions of chair 10, transition positions of chair 10 and descend positions of chair 10 to a patient entry position no more than nineteen inches from the floors in ways not provided by the prior art.

A combination of a seat, lift system, swivel system, swivel lock system and base of the disclosed technology provide a chair which when in a patient entry position is no more than nineteen inches from the floor.

A combination of a seat, lift system and mobility system of the disclosed technology provide a chair which when in a patient entry position is no more than nineteen inches from the floor.

A combination of a seat, lift system, leg rest, swivel system, swivel lock system and base of the disclosed technology provide a chair which when in a patient entry position is no more than nineteen inches from the floor.

A combination of a seat, lift system, leg rest, foot rest, swivel system, swivel lock system and base of the disclosed technology provide a chair which when in a patient entry position is no more than nineteen inches from the floor.

The disclosed technology may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An examination chair disposed on a floor comprising:

A seat onto which a person transfers when moving onto and off the chair, the seat comprising an upper surface having one or more contours defining a vertically highest point of the seat;

A leg rest assembly disposed adjacent the seat;

Means for programmably providing infinite incremental extensions of the leg rest assembly between a fully retracted position through a fully extended position;

Means for programmably providing infinite incremental raising and lowering the leg rest assembly relative to the seat between a substantially right angle position relative to the seat through a substantially parallel position relative to the seat, wherein the means for programmably providing infinite incremental extensions of the leg rest assembly operates mechanically independent of the means for programmably providing infinite incremental raising and lowering of the leg rest assembly.

2. The chair of claim 1 further comprising a programmable lift system connected to the seat for incrementally raising and lowering the seat, the lift system capable of moving the highest vertical point of the seat to a height no higher than nineteen inches from the floor.

3. The chair of claim 1 further comprising a chair swivel system disposed between the seat and the floor; swivel locking system disposed between the seat and the floor; and a base disposed between the swivel system and the floor.

4. The chair of claim 3 wherein the swivel locking system comprises:

a swivel disc fixedly attached to the base a distance from the swivel system exposing just one side of the swivel disc adjacent the swivel system defining a gap between the swivel system and the swivel disc, a housing fixed to the swivel system and disposed a distance away from the swivel disc; two legs rotatably disposed in the housing adjacent the exposed side of the swivel disc, distal ends of the legs extending toward the swivel disc; means for biasing the legs toward each other such that the distal ends of one or more legs span the gap between the swivel system and the swivel disc contacting the exposed side of the swivel disc to releasably fix the relative positions of the swivel system and the swivel disc; means for selectively biasing the distal ends of the legs away from each other such that neither leg contacts the swivel disc.

5. The chair of claim 4 wherein the means for biasing the legs toward each other comprises a spring having a first end and a second end, the first end of the spring fixed to one leg and the second end of the spring fixed to the other leg.

6. The chair of claim 4 wherein the means for selectively biasing the distal ends of the legs away from each other such that neither leg contacts the swivel disc comprises a linear actuator which rotates the legs about a plug overcoming bias of the spring and moving the distal ends of the legs away from each other whereby the distal ends of the legs are moved a distance away from the swivel disc.

7. The chair of claim 3 wherein the swivel system and swivel locking system comprise a combined vertical thickness of about one inch.

8. The chair of claim 3 further comprising a programmable lift system connected to the seat for incrementally raising and lowering the seat, the lift system capable of moving the highest vertical point of the seat to a height no higher than nineteen inches from the floor.

9. The chair of claim 1 wherein the lowering of the leg rest assembly is programmably delayed, slowed or paused for a sufficient period or periods of time to permit the retraction of an extension of the leg rest assembly whereupon the lowering of the leg rest assembly programmably resumes without additional user input or request to lower the leg rest assembly to its substantially right angle position relative to the seat and maintaining a distance between the leg rest assembly and the floor.

10. The chair of claim 1 wherein the lowering of the seat is programmably delayed, slowed or paused for a sufficient period or periods of time to permit the retraction of an extension of the leg rest assembly whereupon the lowering of the seat programmably resumes without additional user input or request to move the highest vertical point of the seat to a height no higher than nineteen inches from the floor and maintaining a distance between the leg rest assembly and the floor.

11. The chair of claim 1 further comprising means for programmably providing infinite incremental inclination of the seat.

12. The chair of claim 11 wherein the inclination of the seat is programmably delayed, slowed or paused for a sufficient period or periods of time to permit the retraction of an extension of the leg rest assembly whereupon the inclination of the seat programmably resumes without additional user input or request to move the highest vertical point of the seat to a height no higher than nineteen inches from the floor and maintaining a distance between the leg rest assembly and the floor.

13. The chair of claim 1 further comprising a foot rest.

14. An examination chair disposed on a floor comprising:

A seat onto which a person transfers when moving onto and off the chair, the seat comprising an upper surface having one or more contours defining a vertically highest point of the seat;

A leg rest assembly disposed adjacent the seat;

Means for programmably providing infinite incremental extensions of the leg rest assembly to a fully extended position;

Means for programmably providing infinite incremental raising and lowering the leg rest assembly relative to the seat between a substantially right angle position relative to the seat through a substantially parallel position relative to the seat;

A foot rest hingedly attached to the leg rest assembly; and

Means for programmably providing infinite incremental rotation of the foot rest about the hinge relative to the leg rest assembly between a substantially right angle position relative to the leg rest assembly through a substantially parallel position relative to the leg rest assembly; wherein the means for programmably providing infinite incremental extensions of the leg rest assembly operates mechanically independent of the means for programmably providing infinite incremental rotation of the foot rest.

15. The chair of claim 14 further comprising a programmable lift system connected to the seat for incrementally raising and lowering the seat, the lift system capable of moving the highest vertical point of the seat to a height no higher than nineteen inches from the floor.

16. The chair of claim 14 further comprising a chair swivel system disposed between the seat and the floor; a swivel locking system disposed between the seat and the floor; and a base disposed between the swivel system and the floor.

17. The chair of claim 16 wherein the swivel system and swivel locking system comprise a combined vertical thickness of about one inch.

18. The chair of claim 16 further comprising a programmable lift system connected to the seat for incrementally raising and lowering the seat, the lift system capable of moving the highest vertical point of the seat to a height no higher than nineteen inches from the floor.

19. The chair of claim 14 wherein the lowering of the leg rest assembly is programmably delayed, slowed or paused for a sufficient period or periods of time to permit rotation of the foot rest whereupon the lowering of the leg rest assembly programmably resumes without additional user input or request to lower the leg rest assembly to its substantially right angle position relative to the seat and maintaining a distance between the foot rest and the floor.

20. The chair of claim 14 wherein the lowering of the seat is programmably delayed, slowed or paused for a sufficient period or periods of time to permit the rotation of the foot rest whereupon the lowering of the seat programmably resumes without additional user input or request to move the highest vertical point of the seat to a height no higher than nineteen inches from the floor and maintaining a distance between the foot rest and the floor.

21. The chair of claim 14 further comprising means for programmably providing infinite incremental inclination of the seat wherein the inclination of the seat is programmably delayed, slowed or paused for a sufficient period or periods of time to permit the rotation of the foot rest whereupon the inclination of the seat programmably resumes without additional user input or request to move the highest vertical point of the seat to a height no higher than nineteen inches from the floor and maintaining a distance between the foot rest and the floor.

* * * * *